US007654855B2

(12) United States Patent
Liao

(10) Patent No.: US 7,654,855 B2
(45) Date of Patent: Feb. 2, 2010

(54) SOCKET ASSEMBLY

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 11/987,433

(22) Filed: Nov. 30, 2007

(65) Prior Publication Data

US 2009/0047827 A1 Feb. 19, 2009

(30) Foreign Application Priority Data

Aug. 17, 2007 (TW) ..... 96130539 A

(51) Int. Cl.
*H01R 4/24* (2006.01)

(52) U.S. Cl. ..... 439/441

(58) Field of Classification Search ..... 439/441, 439/188, 501; 174/53; 242/398
See application file for complete search history.

(56) References Cited

U.S. PATENT DOCUMENTS 5,035,630 A * 7/1991 Norsworthy ..... 439/92
5,679,925 A * 10/1997 Dilley ..... 174/53
5,734,254 A * 3/1998 Stephens ..... 320/106
7,176,404 B2 * 2/2007 Herres ..... 219/121.5
7,403,803 B2 * 7/2008 Mickle et al. ..... 455/573

* cited by examiner

*Primary Examiner*—Jean F Duverne
(74) *Attorney, Agent, or Firm*—Rosenberg, Klein & Lee

(57) ABSTRACT

A socket assembly includes a socket body, a connecting line and an electrical connector. The socket body comprises a panel and at least one socket unit. The socket body is provided with a receiving trough. One end of the connecting line extends into the inside of the socket body. The electrical connector is connected to the other end of the connecting line. The connecting line and the electrical connector are stored in the receiving trough or extend beyond the receiving trough selectively. Via the above arrangement, the socket assembly of the present invention can provide a connecting line and an electrical connector to facilitate the user to quickly connect electronic products. Further, when the connecting line and the electrical connector are not in use, they can be stored in the socket body and thus may not cause clutter and disturbance.

20 Claims, 10 Drawing Sheets

SOCKET ASSEMBLY

BACKGROUND OF THE INVENTION

1. Field of the Invention

The present invention is related to a socket assembly, and more particular to a socket assembly that can provide a connecting line and an electrical connector quickly to facilitate a user to connect to an electronic product.

2. Description of Related Art

Electronic products (such as mobile phone, digital camera, PDA or other portable electronic products) need to be supplied with electricity by connecting to a power supply, in order to maintain their normal operation. Therefore, it is necessary to use a public power as a power supply.

The existing cable arrangement for distributing the public power is embedded in walls of a house. Sockets provided on the wall are used to connect with the public power line or a signal line. When the electricity of an electronic product is depleted and the product needs to be connected to a power supply to maintain its operation, or the electronic product has to be connected to Internet to transmit information, the user can utilize a transmission line and a plug to connect the electronic product to a socket, so that the electronic product can be connected with a public power or signal line, thereby obtaining electricity or accessing Internet signals.

Furthermore, the continuous development of electronic products also promotes diversity of the associated electrical connectors. Various kinds of electrical connectors are available on the market, such as a USB connector. When the electronic product has to be connected to another electronic device such as a computer, an associated electrical connector and a connecting line are used to connect the electronic product with the electric device electrically, so that electric power or signals can be transmitted between the electronic product and the electronic device via the connecting line.

Although the conventional socket can be provided with an electrical connector suitable for plugging into an electronic product, it still does not have a connecting line. Therefore, in order to connect the electronic product to the socket, the user needs to spend time in finding a suitable connecting line. After use, the user has to remove the connecting line and store it in a proper location. Further, the connecting line may get lost easily after removal, causing inconvenience for the user. If the connecting line is not removed, it may result in clutter and disturbance around the socket area.

Consequently, because of the above technical defects, the inventor keeps on carving unflaggingly through wholehearted experience and research to develop the present invention, which can effectively improve the defects described above.

SUMMARY OF THE INVENTION

The object of the present invention is to provide a socket assembly that can provide a connecting line and an electrical connector quickly to facilitate the user to connect to electronic products. Further, when the connecting line and the electrical connector are not in use, they can be stored in a socket body and thus may not cause clutter and disturbance.

For achieving the object described above, the present invention provides a socket assembly, which includes: a socket body comprising a panel and at least one socket unit, the socket body being provided with a receiving trough; a connecting line with one end thereof extending into the inside of the socket body; and an electrical connector connected to the other end of the connecting line, the connecting line and the electrical connector being stored in the receiving trough or extending outside the receiving trough if desired.

The present invention has advantageous effects as follows. The socket assembly of the present invention is combined with a connecting line and an electrical connector, and the connecting line and the electrical connector are movably provided in the socket body, so that the connecting line and the electrical connector can be drawn out of the socket body freely or stored in the socket body. When a user wants to use the connecting line and the electrical connector, he/she only needs to draw the connecting line and the electrical connector out of the socket body. In this way, the socket assembly can provide a connecting line and an electrical connector quickly, so that the user does not need to spend time in finding a connecting line and an electrical connector. Therefore, it is very convenient to use the present invention. Further, when the connecting line and the electrical connector are not in use, it is not necessary to remove them from the socket assembly. The connecting line and the electrical connector can be stored in the socket body without getting lost. Therefore, it is convenient in the subsequent use, and will not cause clutter and disturbance. Thus, it is very convenient for the user to use the socket assembly of the present invention.

In order to further understand the characteristics and technical contents of the present invention, a detailed description is made with reference to the accompanying drawings. However, it should be understood that the drawings are illustrative only and not to be used to limit the present invention thereto.

DETAILED DESCRIPTION OF THE PREFERRED EMBODIMENTS

Figure 1:
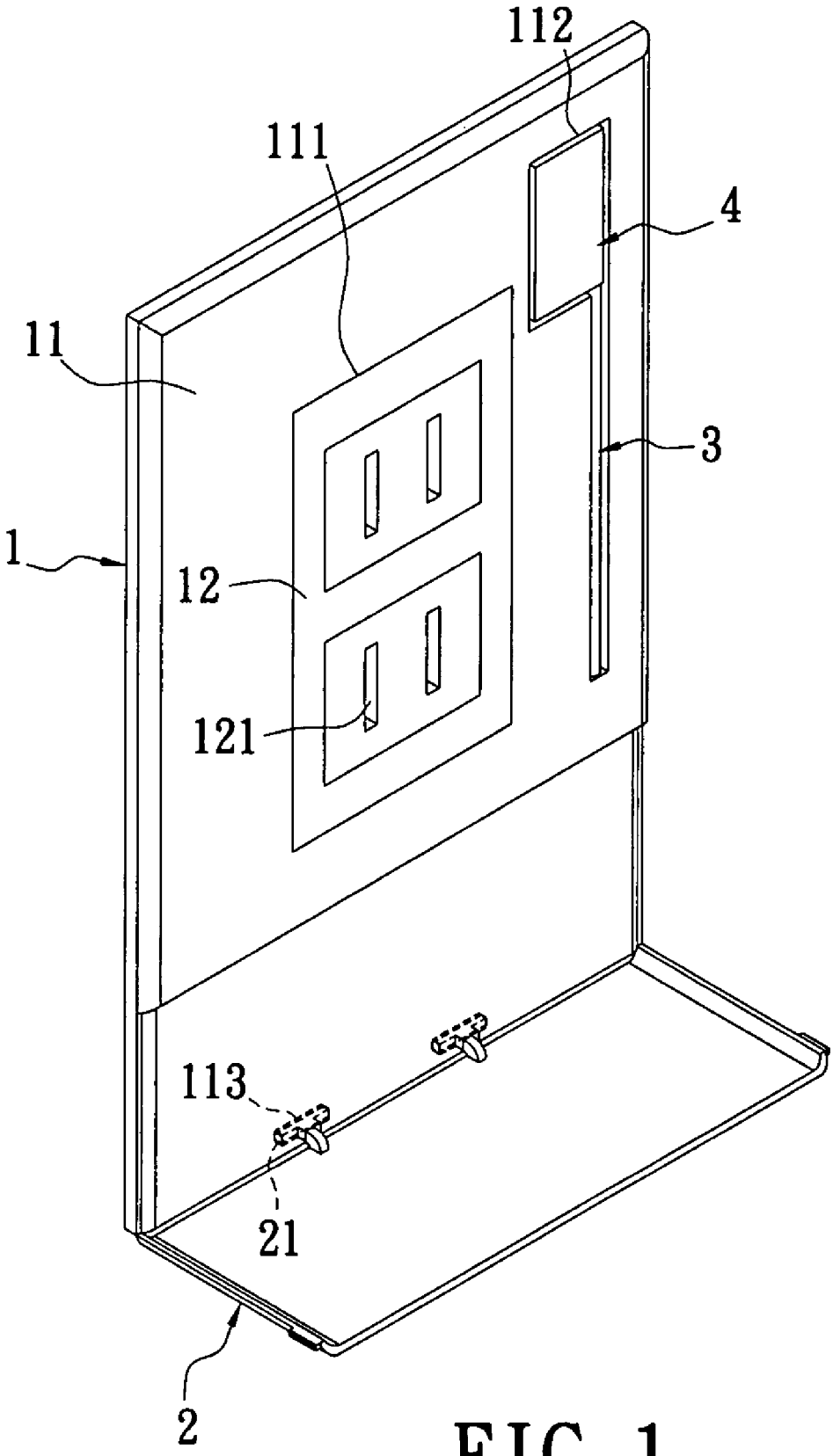
FIG. 1 is a perspective view showing a first embodiment of the socket assembly of the present invention.

The present invention provides a socket assembly. Please refer to FIGS. 1 to 3, which show a first embodiment of the socket assembly of the present invention. The socket assembly includes a socket body 1, a supporting plate 2, a connecting line 3 and an electrical connector 4. The socket body 1 comprises a panel 11 and at least one socket unit 12. The panel 11 is formed by means of laminating a front plate and a rear plate. The panel 11 has an engaging portion 111. In the present embodiment, the engaging portion 111 is a through hole for engaging an outer edge of the socket unit 12 correspondingly.

The panel 11 is provided with an elongated receiving trough 112. The receiving trough 112 is recessed in the panel 11. The shape of the receiving trough 112 substantially corresponds to profiles of the connecting line 3 and the electrical connector, thereby receiving the connecting line 3 and the electrical connector 4. In the present embodiment, the receiving trough 112 is located at one side of the socket unit 12 at an appropriate distance. The receiving trough 112 is provided in an upright manner. The bottom of the panel 11 is provided with two first pivoting portions 113. The two first pivoting portions are pivotal holes for pivotally connecting the supporting plate 2.

The socket unit 12 is engaged in the engaging portion 111 of the panel 11. The socket unit 12 has at least one set of insertion holes 121. The set of insertion holes 121 are insertion holes for a power supply line, Internet line or telephone line. The insertion holes can be various kinds of insertion holes or electrical connectors.

The supporting plate 2 is located on a front side of the panel. One side of the supporting plate 2 is provided with two pivoting portions 21. The two pivoting portions 21 are pivotal shafts. One side of the supporting plate 2 is pivotally connected with two first pivoting portions 113 on the bottom of the panel 11 via the two second pivoting portions 21. Therefore, the supporting plate 2 is connected to the socket body 1 in such a way that the supporting plate can turn over with respect to the socket body. The supporting plate 2 can be turned downwardly to a horizontal position for allowing an electronic product 6 to be disposed thereon. Alternatively, the supporting plate 2 can be turned upwardly, so that it can be overlapped on the front side of the panel 1.

The connecting line 3 is configured that the interior thereof is provided with conductors and the exterior of the conductors is covered with an insulating layer. However, the structure and the type of the connecting line 3 are not limited thereto. The connecting line 3 can be various cables or wires. One end of the connecting line 3 extends into the inside of the panel 11 of the socket body 1 from one end of the receiving trough 112 and thus can be electrically connected with an electronic device such as a computer. The connecting line 3 can be stored in the receiving trough 112, so that the connecting line 3 can be fixed properly when not in use. In addition, the connecting line 3 can extend beyond the receiving trough 112, thereby facilitating the use.

The electrical connector 4 can be various kinds of electrical connectors such as USB connectors, IEEE1394 connectors, HDMI connectors, AV terminals or DC terminals, which can be made as male or female elements. The electrical connector 4 is connected to the other end of the connecting line 3. The interior of the electrical connector 4 is provided with a plurality of terminals (not shown) that are made of conductive materials. The terminals are electrically connected to the conductors within the connecting line 3, so that the electrical connector 4 can be electrically connected to the connecting line 3. Via the above arrangement, the socket assembly of the present invention can be obtained.

Figure 2:
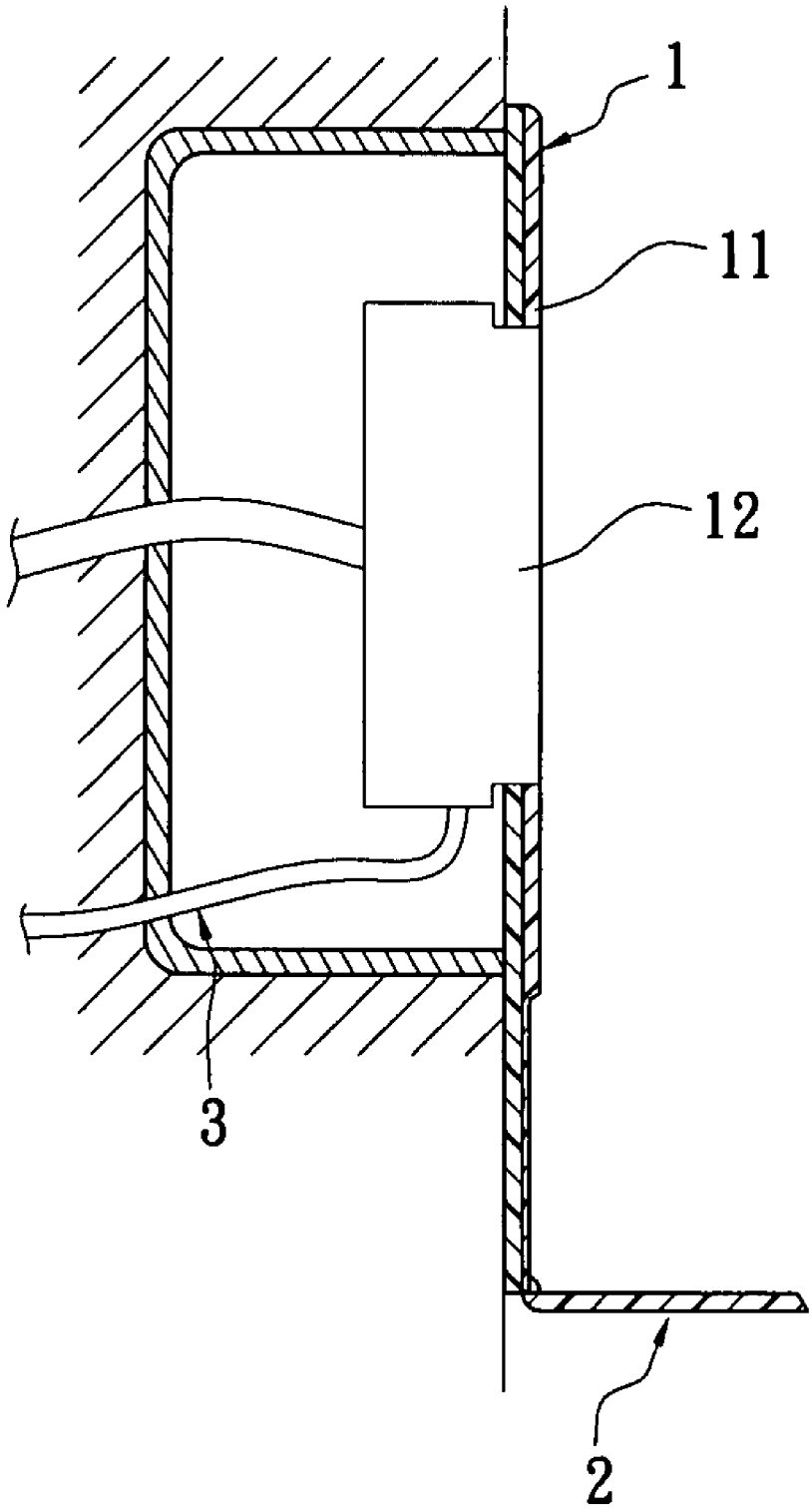
FIG. 2 is a cross-sectional view showing the first embodiment of the socket assembly of the present invention.
Figure 3:
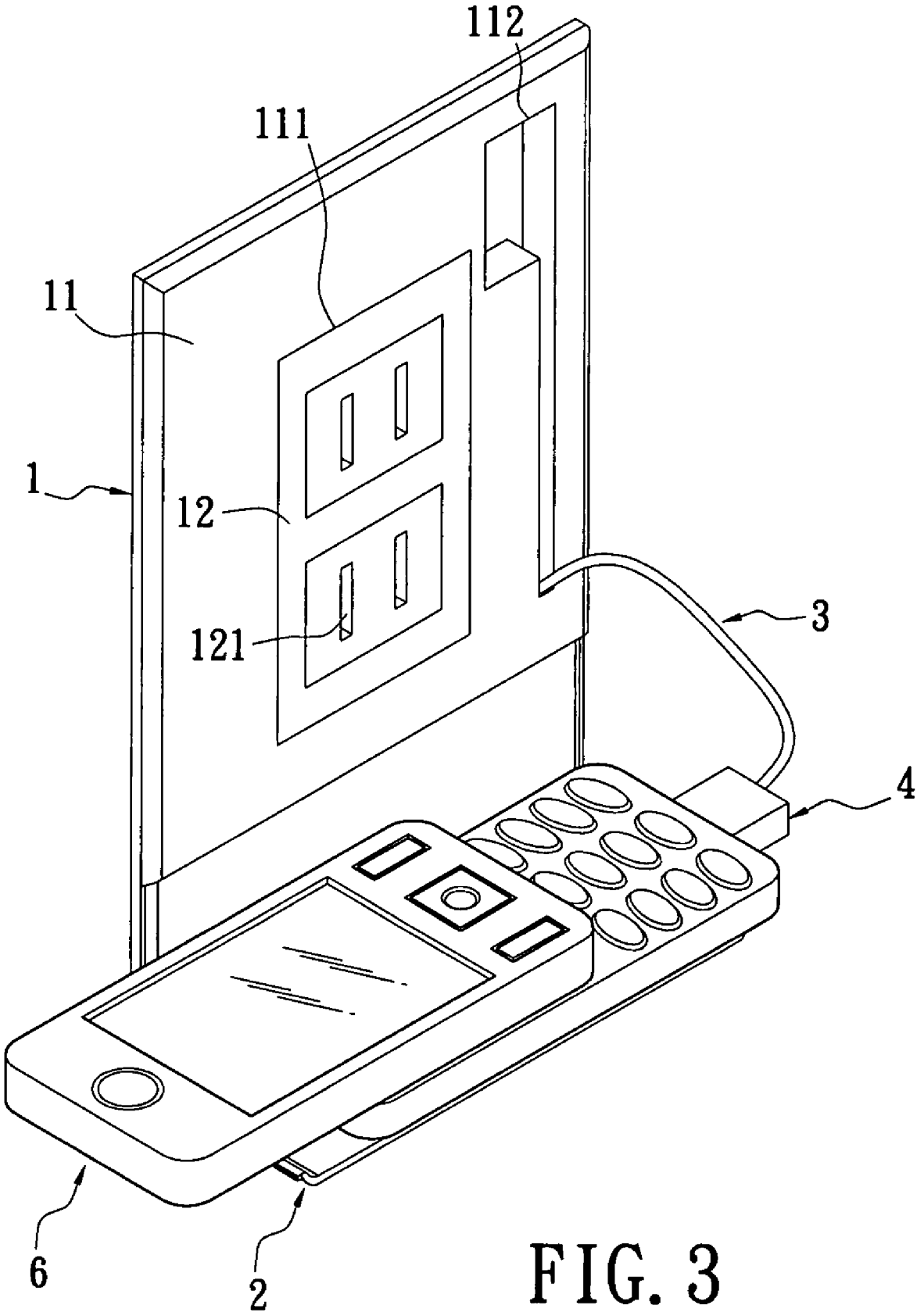
FIG. 3 is a perspective view showing an operating state of the first embodiment of the socket assembly of the present invention.

According to the above arrangement, as shown in FIGS. 1 to 3, in the first embodiment of the present invention, when the user intends to connect an electronic device 6 (e.g. mobile phone) to the electrical connector 4 electrically, the supporting plate 2 can be turned to open with respect to the panel 11, so that the supporting plate 2 is oriented to a horizontal position. Then, the electrical connector 4 is inserted to the electronic product 6, and the electronic product 6 is disposed on the supporting plate 2. In this way, when the electronic product 6 is operated to transmit the electricity and Internet signals with the connecting line 3 and the electrical connector 4, the electronic product can be held steadily.

The socket assembly of the present invention is combined with a connecting line 3 and an electrical connector 4, and the connecting line 3 and the electrical connector 4 are movably provided on the socket body 1, so that the connecting line 3 and the electrical connector 4 can be drawn out of the socket body 1 freely or stored in the socket body 1. When a user wants to use the connecting line 3 and the electrical connector 4, he/she only needs to draw the connecting line 3 and the electrical connector 4 out of the receiving trough 112 of the socket body 1. In this way, the socket assembly can provide a connecting line 3 and an electrical connector 4 quickly, so that the user does not need to spend time in finding a connecting line 3 and an electrical connector 4. Therefore, it is very convenient to use the present invention. On the other hand, when the connecting line 3 and the electrical connector 4 are not in use, it is not necessary to remove them from the socket assembly. The connecting line 3 and the electrical connector 4 can be stored in receiving trough 112 of the socket body 1 without getting lost. Therefore, it is convenient in the subsequent use, and will not cause clutter and disturbance. Thus, it is very convenient for the user to use the socket assembly of the present invention.

Figure 4:
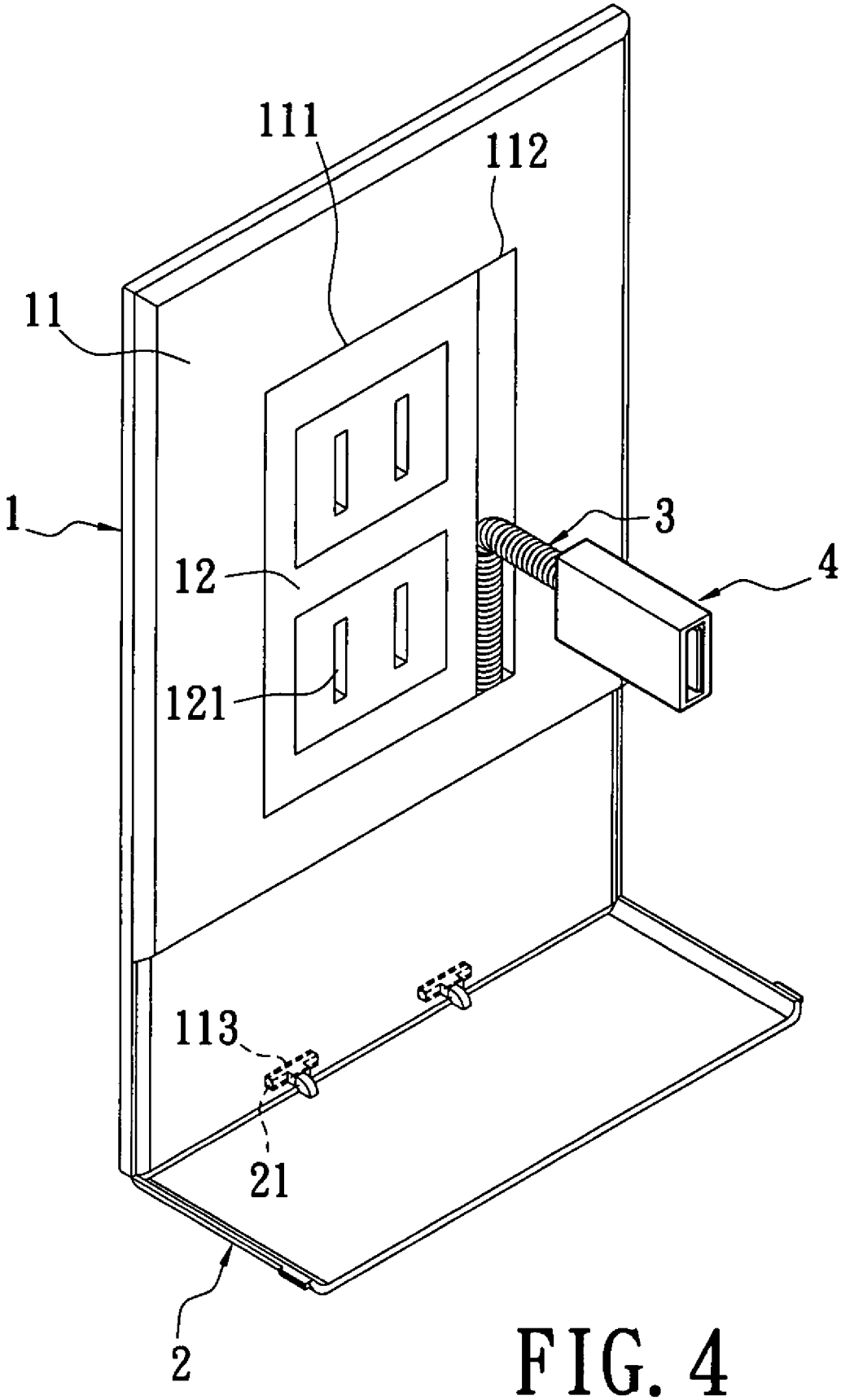
FIG. 4 is a perspective view showing a second embodiment of the socket assembly of the present invention.

Further, please refer to FIG. 4. In a second embodiment of the present invention, the receiving trough 112 is adjacent to one side of the socket unit 12. The connecting line 3 is wrapped spirally, thereby having elasticity for extension. Therefore, the electrical connector 4 can be moved to a desired position more flexibly.

Figure 5:
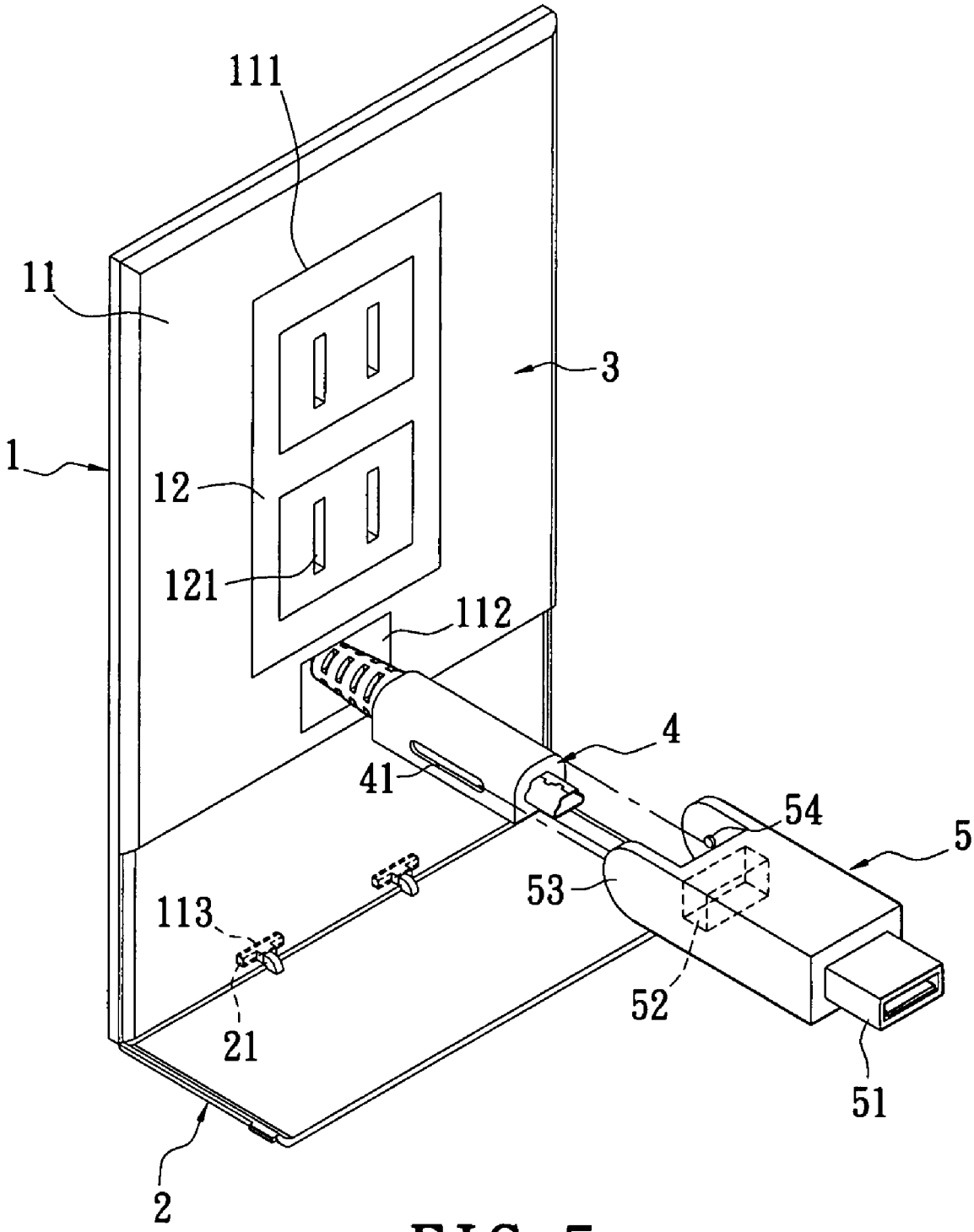
FIG. 5 is a perspective view showing a third embodiment of the socket assembly of the present invention.

Further, please refer to FIG. 5. In a third embodiment of the present, the receiving trough 112 is located on the bottom of the socket unit 12. The receiving trough 112 is provided in the panel 11 to penetrate the inside of the panel 11. Further, the electrical connector 4 is another type of connector. The connecting line 3 and the electrical connector 4 are movably provided in the receiving trough 112, so that the connecting line 3 and the electrical connector 4 can be drawn out of the socket body 1 freely or stored in the socket body 1.

Further, the electrical connector 4 can be combined with an adapter 5. The front and rear ends of the adapter 5 have a first connecting element 51 and a second connecting element 52 respectively. Both sides of the adapter 5 are connected with two side arms 53. The surface of the inner edge of each of the two side arms 53 is formed with a pivoting portion 54. The pivoting portion 54 is a protruding pillar. The two side arms 53 can be rotary or unmovable. In the present embodiment, the two side arms 53 are unmovable, that is the two side arms 53 are fixedly connected to both sides of the adapter 5. If the side arm is rotary, the two side arms can be pivotally connected to both sides of the adapter 5 via pivots, thereby allowing the two side arms 53 to rotate. The first connecting element 51 and the second connecting element 52 are electrically connected with each other. Terminals (not shown) or the like can be provided between the first connecting element 51 and the second connecting element 52, so that the first connecting element 51 can be electrically connected with the second connecting element 52.

Both sides of the electrical connector 4 are recessed inwardly to have a groove 41 respectively. The two grooves 41 extend horizontally to a proper length. The electrical connector 4 is assembled with the adapter 5 in such a manner that the electrical connector can move forwards and backwards. The pivoting portion 54 is received in the groove 41 correspondingly, so that the electrical connector 4 can be movably assembled with the adapter 5. At the same time, the front end of the electrical connector 4 is inserted into the second connecting element 52, thereby achieving an electrical connection. In this way, the adapter 5 can be electrically connected with the connecting line 3 via the electrical connector 4.

The adapter 5 is movably assembled with the electrical connector 4 by means of pivotal connection or sliding connection. A relative rotating and sliding movement can occur between the electrical connector 4 and the adapter 5, so that the adapter 5 can be inserted into the front end of the electrical connector 4, thereby achieving an adaptive connection. When the adapter 5 is not in use, it can be rotated to different orientations, so that the electrical connector 4 can be used singly without detaching the adapter 5, thereby providing the convenience in using. The structure of the adapter 5 is not limited and can be adapters of any structure and type.

Figure 6:
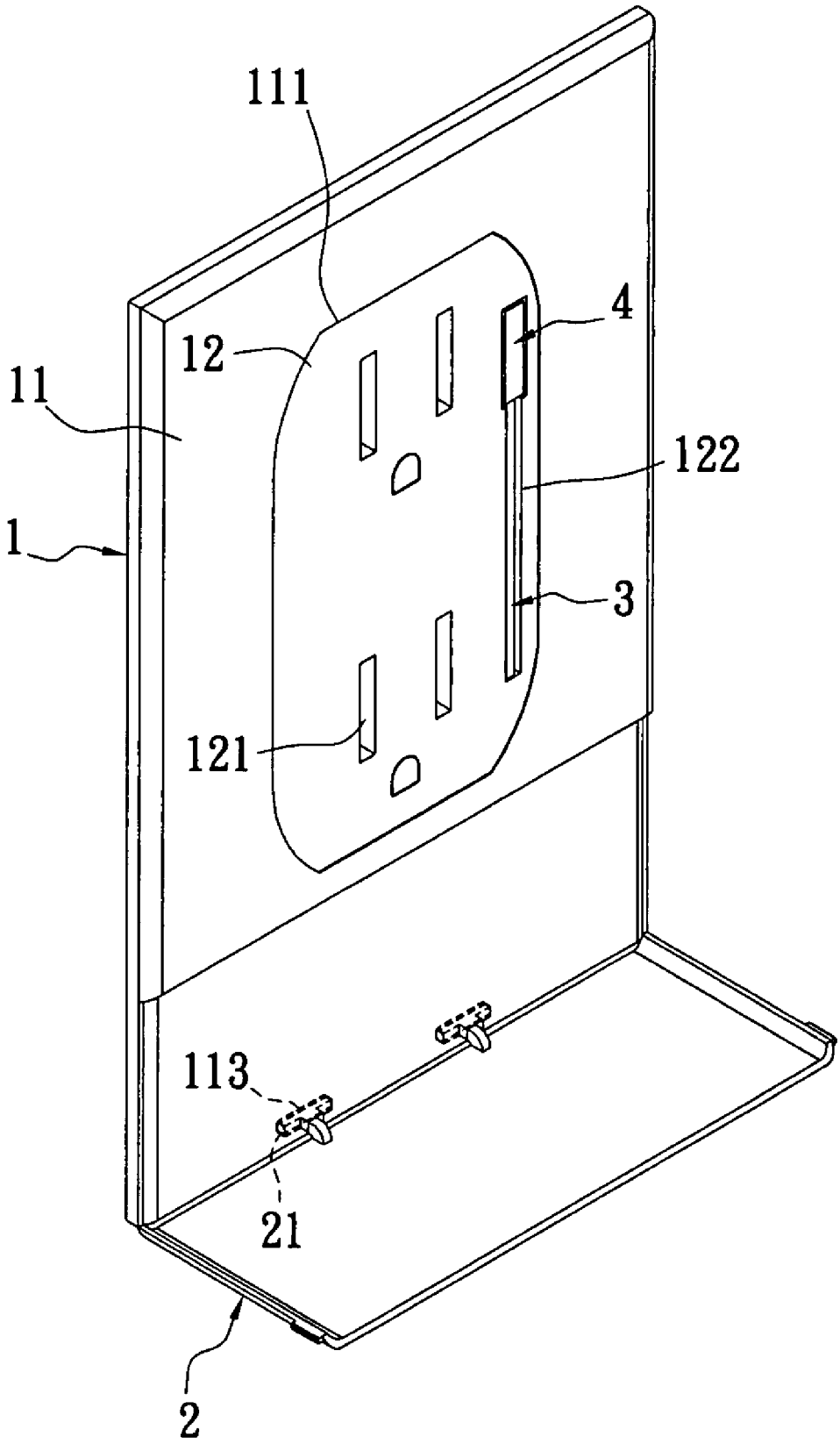
FIG. 6 is a perspective view showing a fourth embodiment of the socket assembly of the present invention.
Figure 7:
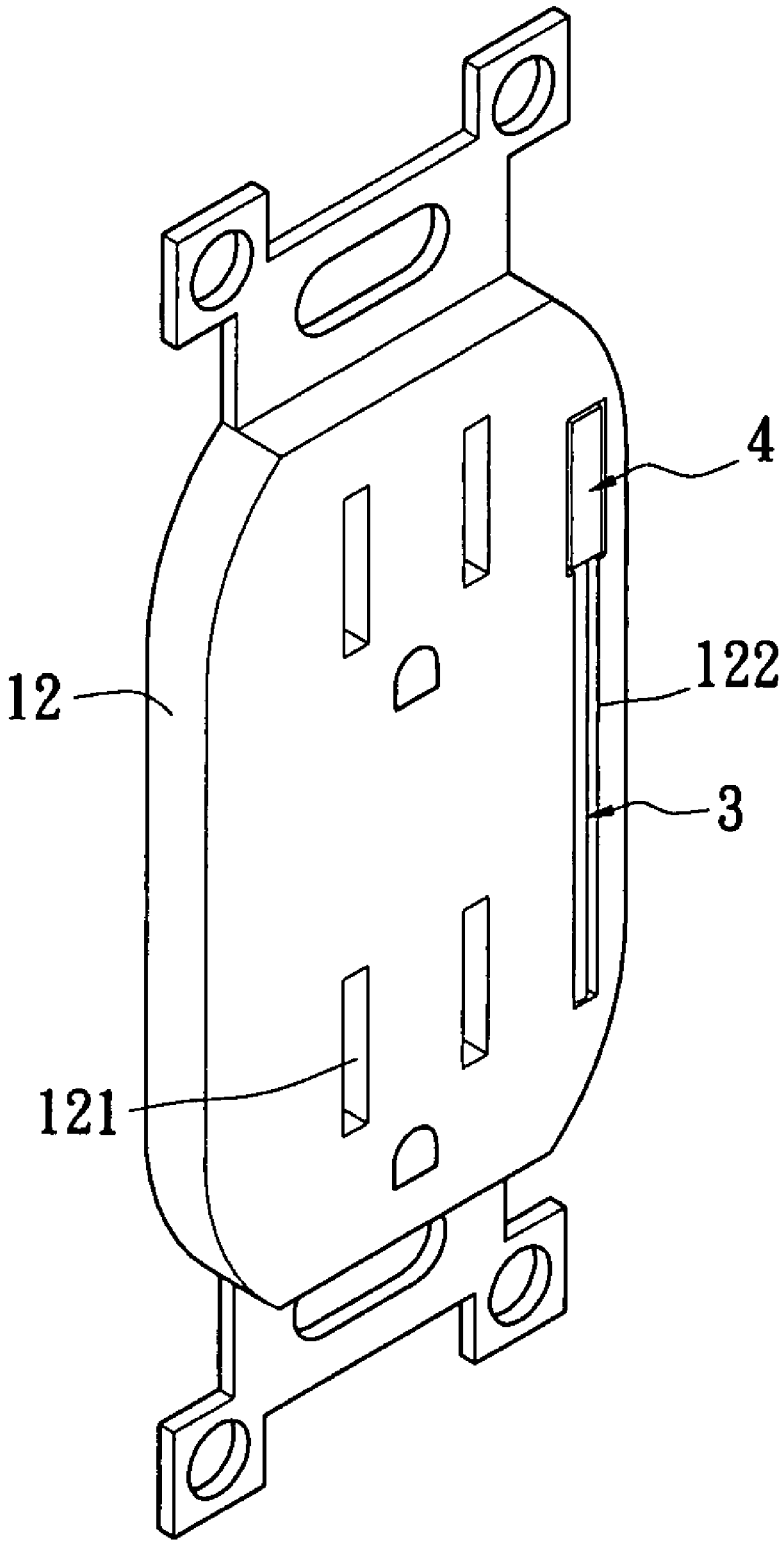
FIG. 7 is a perspective view showing a socket unit of the fourth embodiment of the socket assembly of the present invention.
Figure 8:
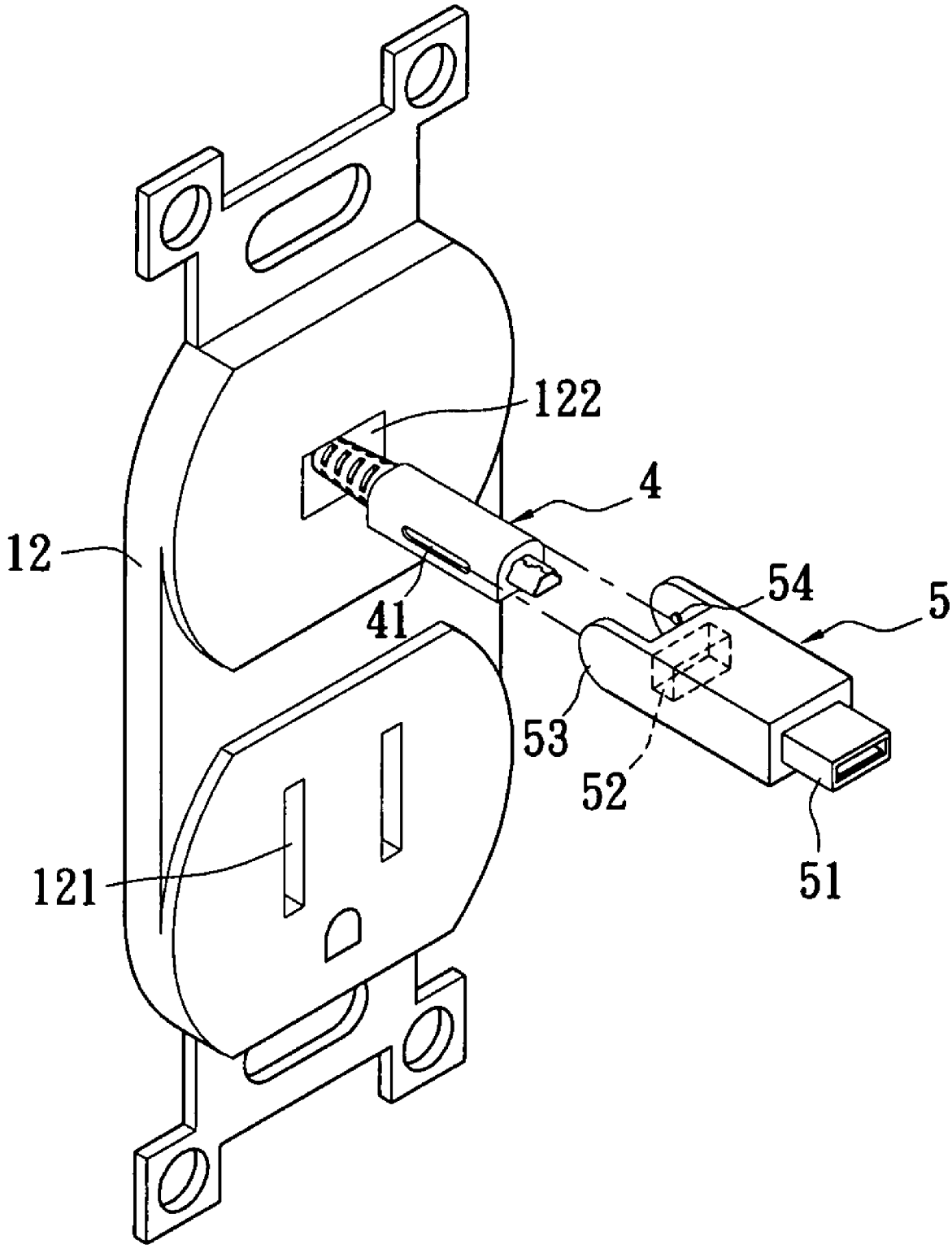
FIG. 8 is a perspective view showing a socket unit of the fifth embodiment of the socket assembly of the present invention.

Further, please refer to FIGS. 6 to 8. In the fourth and fifth embodiments of the present invention, the socket unit 12 has a different structure and type. The socket unit 12 is provided with a receiving trough 122 for replacing the receiving trough 112 of the previous embodiment. The receiving trough 122 is recessed in or penetrates the socket unit 12, so that the connecting line 3 and the electrical connector 4 can be stored in the receiving trough 122 or extend beyond the receiving trough 122 selectively.

Figure 9:
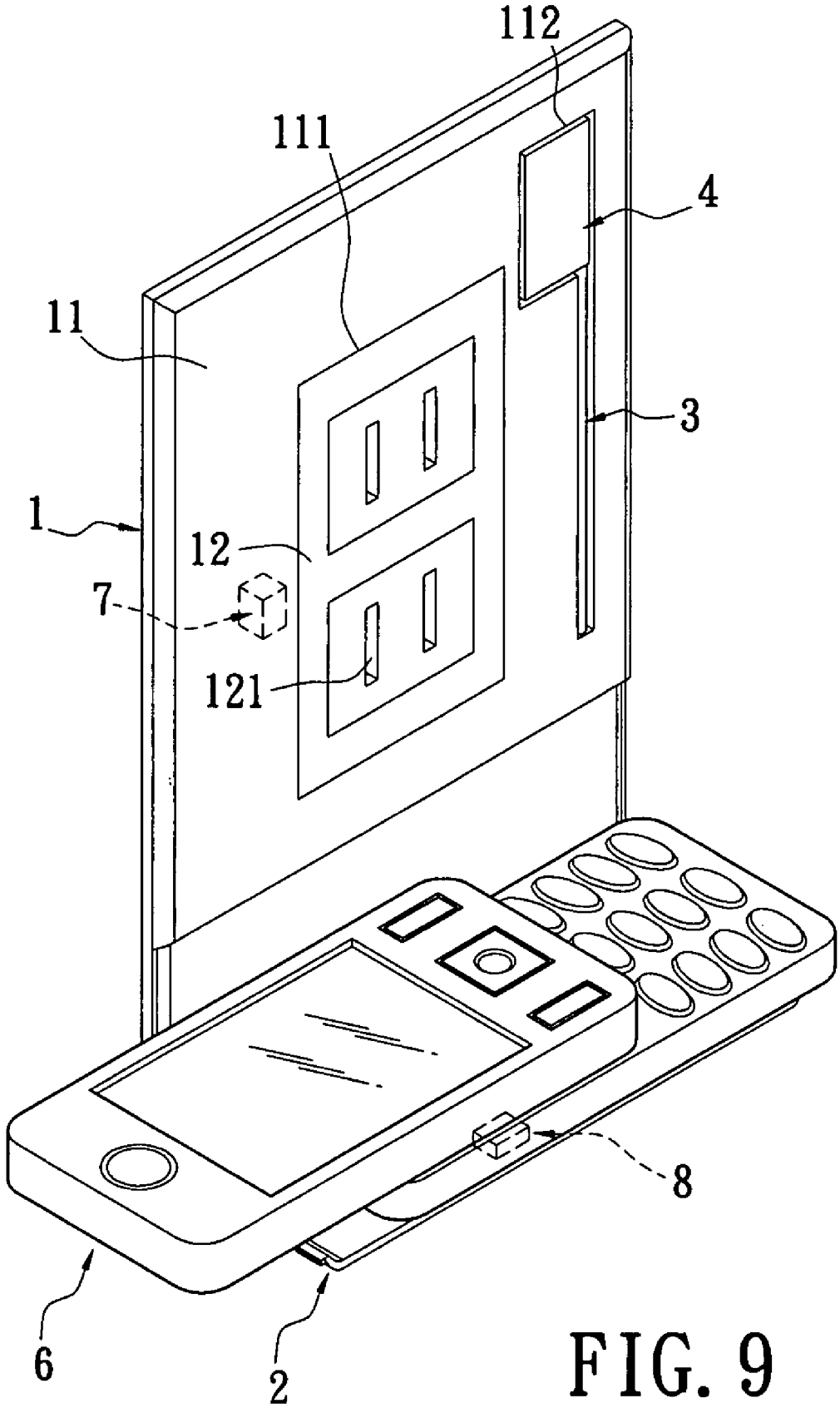
FIG. 9 is a perspective view showing a sixth embodiment of the socket assembly of the present invention.

Further, please refer to FIG. 9. In a sixth embodiment of the present invention, the socket body 1 of the socket assembly is provided thereon with a wireless charge transmitter 7. The wireless charge transmitter 7 is electrically connected to a circuit unit of the socket assembly. Also, the electronic product 6 is provided thereon with a wireless charge receiver 8. Power transmission is performed between the wireless charge transmitter 7 and the wireless charge receiver 8 based on a wireless transmission protocol. In this way, the electronic product 6 disposed on the supporting plate 2 can be charged by means of a wireless charging process.

Figure 10:
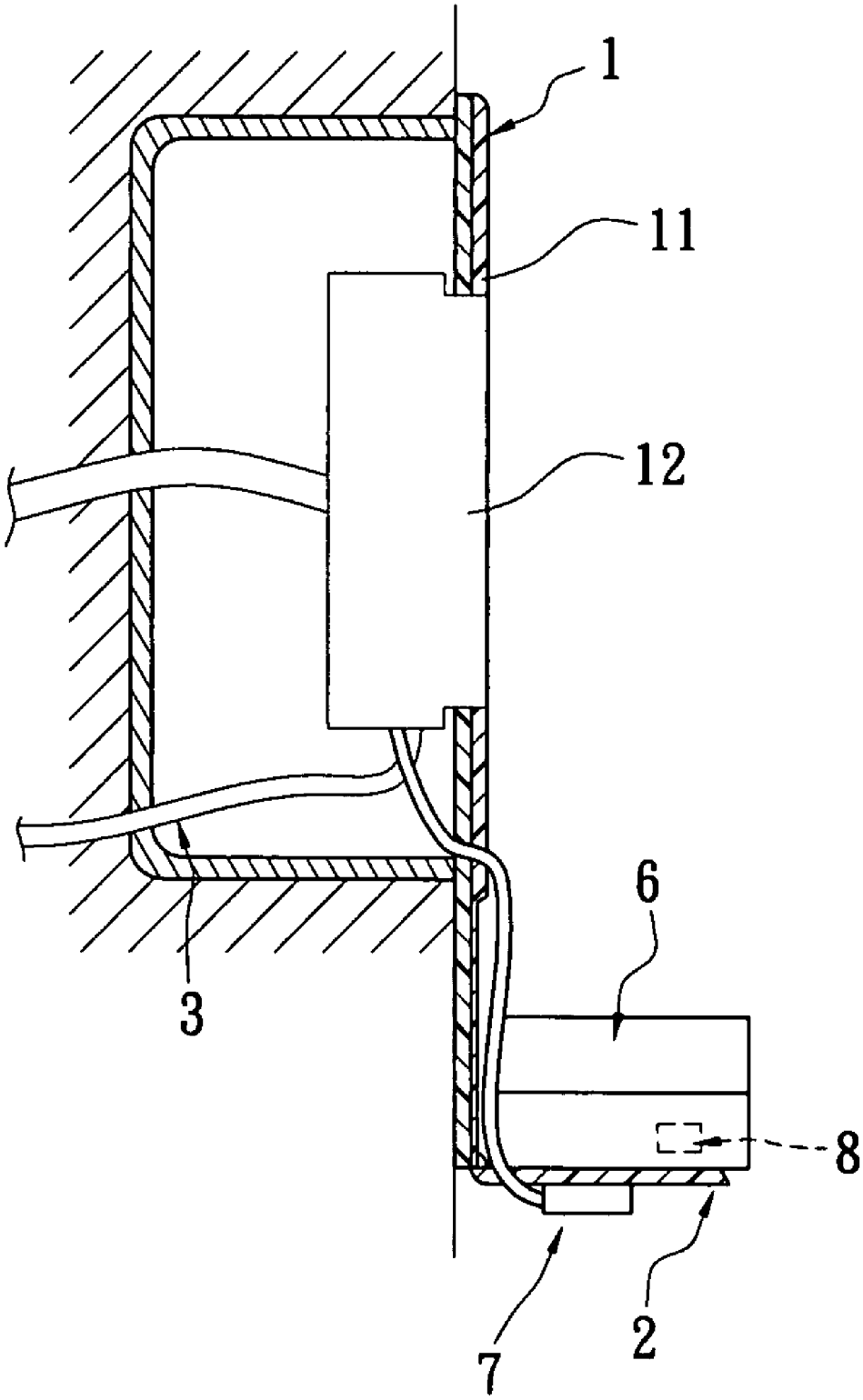
FIG. 10 is a cross-sectional view showing a seventh embodiment of the socket assembly of the present invention.

Further, please refer to FIG. 10. In a seventh embodiment of the present invention, the supporting plate 2 of the socket assembly is provided thereon with a wireless charge transmitter 7. The wireless charge transmitter 7 is electrically connected to a circuit unit of the socket assembly. Also, the electronic product 6 is provided thereon with a wireless charge receiver 8. Power transmission is performed between the wireless charge transmitter 7 and the wireless charge receiver 8 based on a wireless transmission protocol. In this way, the electronic product 6 disposed on the supporting plate 2 can be charged by means of a wireless charging process.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A socket assembly, comprising:

a socket body comprising a panel and at least one socket unit, the socket body being provided with a receiving trough, the socket body having a supporting plate configured to extend transversely therefrom;

a connecting line with one end thereof extending into the socket body; and an electrical connector connected to the other end of the connecting line, the connecting line and the electrical connector being selectively stored in the receiving trough or extending outside the receiving trough, the electrical connector being combined with an adapter, and the adapter being movably combined with the electrical connector.

2. The socket assembly according to claim 1, wherein the panel has an engaging portion, and the engaging portion is engaged with an outer edge of the socket unit.

3. The socket assembly according to claim 1, wherein the receiving trough is provided on the panel and is located at a distance on one side of the socket unit.

4. The socket assembly according to claim 1, wherein the receiving trough is provided on the panel and is adjacent to one side of the socket unit.

5. The socket assembly according to claim 1, wherein the receiving trough is provided on the panel and is located at the bottom of the socket unit.

6. The socket assembly according to claim 1, wherein the receiving trough is recessed in the panel.

7. The socket assembly according to claim 1, wherein the receiving trough penetrates the panel, and the connecting line and the electrical connector are movably provided in the receiving trough.

8. The socket assembly according to claim 1, wherein the receiving trough is provided on the socket unit.

9. A socket assembly, comprising:

a socket body comprising a panel and at least one socket unit, the socket body being provided with a receiving trough;

a connecting line with one end thereof extending into the socket body; and an electrical connector connected to the other end of the connecting line, the connecting line and the electrical connector being stored in the receiving trough or extending outside the receiving trough if desired;

wherein the panel is pivotally connected with a supporting plate, and the supporting plate is turned to a horizontal location or laminated on the front side of the panel.

10. The socket assembly according to claim 9, wherein the bottom of the panel is provided with first pivoting portions, one side of the supporting plate is provided with second pivoting portions, the second pivoting portion and the first pivoting portion are pivotally connected to each other.

11. The socket assembly according to claim 1, wherein the socket unit has at least one set of insertion holes.

12. The socket assembly according to claim 1, wherein one end of the connecting line extends to the inside of the socket body via the receiving trough.

13. The socket assembly according to claim 1, wherein the connecting line is wrapped spirally.

14. A socket assembly, comprising:

a socket body comprising a panel and at least one socket unit, the socket body being provided with a receiving trough;

a connecting line with one end thereof extending into the socket body; and an electrical connector connected to the other end of the connecting line, the connecting line and the electrical connector being stored in the receiving trough or extending outside the receiving trough if desired;

wherein the electrical connector is combined with an adapter, and the adapter is movably combined with the electrical connector;

wherein the adapter has a first connecting element and a second connecting element, the second connecting element is inserted into the electrical connector, both sides of the adapter are connected with two side arms, the surface of the inner edge of each of the two side arms is formed with a pivoting portion, the first and second connecting elements are electrically connected to each other, both sides of the electrical connector are provided with a groove respectively, the two pivoting portions are received in the two grooves correspondingly.

15. A socket assembly, comprising:

a socket body having a socket unit, the socket unit being provided with a receiving trough, the socket body having a supporting plate configured to extend transversely therefrom;

a connecting line with one end thereof extending into the socket body; and an electrical connector connected to the other end of the connecting line, the connecting line and the electrical connector being selectively stored in the receiving trough or extending outside the receiving trough, the electrical connector being combined with an adapter, and the adapter being movably combined with the electrical connector.

16. The socket assembly according to claim 15, wherein the socket unit has at least one set of insertion holes.

17. The socket assembly according to claim 15, wherein one end of the connecting line extends to the inside of the socket body via the receiving trough.

18. The socket assembly according to claim 15, wherein the connecting line is wrapped spirally.

19. The socket assembly according to claim 15, wherein a wireless charge transmitter is provided, and an electronic product is provided thereon with a wireless charge receiver, thereby charging the electronic product via a wireless charging process.

20. A socket assembly, comprising:

a socket body having a socket unit, the socket unit being provided with a receiving trough;

a connecting line with one end thereof extending into the socket body;

an electrical connector connected to the other end of the connecting line, the connecting line and the electrical connector being stored in the receiving trough or extending outside the receiving trough if desired; and an adapter, wherein the adapter has a first connecting element and a second connecting element, the second connecting element is inserted to the electrical connector, both sides of the adapter are connected with two side arms, the surface of the inner edge of each of the two side arms is formed with a pivoting portion, the first and second connecting elements are electrically connected to each other, both sides of the electrical connector are provided with a groove respectively, the two pivoting portions are received in the two grooves correspondingly.

* * * * *